US006860915B2

(12) United States Patent
Stegmaier et al.

(10) Patent No.: US 6,860,915 B2
(45) Date of Patent: Mar. 1, 2005

(54) OIL SEPARATING DEVICE FOR CRANKCASE GASES OF AN INTERNAL COMBUSTION ENGINE

(75) Inventors: Juergen Stegmaier, Stuttgart (DE); Bruno Hezel, Stuttgart (DE); Dietmar Uhlenbrock, Tecklenburg (DE)

(73) Assignee: Robert Bosch GmbH, Stuttgart (DE)

( * ) Notice: Subject to any disclaimer, the term of this patent is extended or adjusted under 35 U.S.C. 154(b) by 108 days.

(21) Appl. No.: 10/343,653

(22) PCT Filed: Mar. 16, 2002

(86) PCT No.: PCT/DE02/00964

§ 371 (c)(1),
(2), (4) Date: Feb. 3, 2003

(87) PCT Pub. No.: WO02/099256

PCT Pub. Date: Dec. 12, 2002

(65) Prior Publication Data

US 2004/0003579 A1 Jan. 8, 2004

(30) Foreign Application Priority Data

Jun. 7, 2001 (DE) ..... 101 27 820

(51) Int. Cl.[7] ..... B01D 50/00

(52) U.S. Cl. ..... 55/337; 55/385.3; 55/417; 55/428; 55/457; 55/DIG. 19; 96/190; 123/572

(58) Field of Search ..... 55/320, 337, 385.3, 55/417, 428, 457, DIG. 19; 96/190; 123/572

(56) References Cited

U.S. PATENT DOCUMENTS

| | | | | |
|---|---|---|---|---|
| 4,966,703 | A | 10/1990 | Kalnins | |
| 5,466,384 | A | 11/1995 | Prevost | |
| 6,290,738 | B1 * | 9/2001 | Holm | 55/309 |
| 6,309,436 | B1 * | 10/2001 | Holch | 55/337 |

FOREIGN PATENT DOCUMENTS

DE 197 00 733 A 7/1998

* cited by examiner

*Primary Examiner*—Robert A. Hopkins
(74) *Attorney, Agent, or Firm*—Michael J. Striker

(57) ABSTRACT

The invention concerns an oil separator (2) for crankcase gases of an internal combustion engine, comprising a preliminary separator (28), a cyclone separator (30), a fine separator (32) and, if necessary, a valve device (36) that are provided in a cascade arrangement on a cylinder-head cover (4) of the internal combustion engine; in order to create an oil separator for use in various engines having different quantities of crankcase gas, said oil separator is designed so that, as an option, helixes (48) having different radial depths of the flow path can be inserted in a housing section for the cyclone separator (30).

9 Claims, 6 Drawing Sheets

OIL SEPARATING DEVICE FOR CRANKCASE GASES OF AN INTERNAL COMBUSTION ENGINE

BACKGROUND OF THE INVENTION

The invention is based on an oil separator for crankcase gases of an internal combustion engine, comprising a preliminary separator, a cyclone separator, a fine separator and, if necessary, a valve device that are provided in a cascade arrangement on a cylinder-head hood of the internal combustion engine.

When an internal combustion engine operates, streams of blowby gas are produced between pistons, piston rings, and cylinder walls and, if applicable, in the region of valve guides. This blowby gas—which enters the crankcase or a camshaft housing, or travels above the cylinder head or is guided there—contains fluid components, primarily fine oil droplets or motor oil components with a low boiling point. Larger oil droplets can also be contained in the crankcase gas or even in the camshaft housing gas that are produced by moving drivetrain parts, i.e., piston, connecting rod, crankshaft or camshaft. This is also referred to as "swirl oil". In order to remove the blowby gases, a venting of the crankcase—which usually extends over the camshaft housing—is provided. These gas/fluid quantities referred to as crankcase gas and occurring intermittently are separated from the fluid components by means of an oil separator and then typically directed to the intake region of the internal combustion engine. By separating the oil, dirt is prevented from accumulating in the downstream regions, and the emission of hydrocarbons is not increased in an undesired fashion.

In the cyclone separator of the oil separator mentioned hereinabove, the crankcase gas is directed through a helical flow path, where it flows very rapidly. Due to the centrifugal forces produced, the fluid components of the crankcase gas are separated radially outwardly on a wall bordering the helical flow path, and the liquid phase travels downward along the helical path because of its weight. It is understood that the flow rate of the crankcase gas inside the helical flow path depends on the quantity of crankcase gas produced per unit of time and on the flow cross-section of the flow path. The quantity of crankcase gas produced per unit of time depends on the piston displacement of a motor vehicle, among other things. For example, with a diesel engine having a piston displacement of 2 to 2.5 l, quantities of crankcase gas amounting to approximately 65 l/min are produced. With some engines, however, only approximately 50 l/min are directed into the oil separator. The minimum quantity should be considered to be 40 l/min.

This makes it necessary for the cyclone separator and/or the helical flow path to be configured with a different flow cross-section depending on the specific requirements. Until now, it was also necessary to produce and stockpile various oil separators each having different cyclone separators for similar engines with different power output, which is considered to be complicated and cost-intensive.

SUMMARY OF THE INVENTION

Based on this, the object of the present invention is to address the problem described hereinabove.

This object is attained, according to the invention, with an oil separator of the type described by the fact that helixes having different radial depths of the flow path limited by said helixes can be inserted in a housing section for the cyclone separator.

It is therefore proposed, according to the invention, to stockpile an oil separator with a cyclone separator, in the case of which different flow cross-sections of the cyclone separator can be obtained by stockpiling various helixes while otherwise retaining the design configuration and dimensions of the oil separator. In this manner, the same oil separator can be used with different engines having various typical quantities of crankcase gas, whereby the specific requirement, i.e., the specific flow cross-section, is obtained by inserting a specific helix having a certain radial depth of the flow path.

In a further development of the invention, the helixes having different radial depths of flow path have the same outer dimensions, so that they can be inserted in the housing section for the cyclone separator without any further adapter parts, such as cylindrical sleeves or the like, for example. As such, the radial inner limitation of the helical flow path varies with these helixes.

According to a further inventive idea, a respective helix comprises a cylindrical internal part (52), whereby this cylindrical internal part (52) defines an inner diameter $D_i$ of the helical flow path.

According to this inventive idea, this helix can be substantially produced by inserting the cylindrical internal part through a central opening of the helical paths with a corresponding opening diameter.

With the present invention, protection is therefore claimed for a system comprising an oil separator with various insertable helixes, each having a different radial depth. It is therefore proposed, according to the invention, to provide various flow cross-sections of the helical flow path by means of various helixes having a varying inner diameter and/or a varying outer diameter, preferably while retaining the outer dimensions of the cyclone separator, i.e., while retaining the design configuration of a housing section for the cyclone separator.

If one assumes a quantity of crankcase gas of approximately 65 l/min, e.g., from a diesel engine having a piston displacement of 2 to 2.5 l, it is found to be advantageous when the flow path is sized such that the cylindrical internal part has a diameter of approximately 8 mm, and the outer diameter of the housing for the cyclone separator is 51 mm with a helical path height (slope) of 13 mm. With a smaller quantity of crankcase gas of only approximately 50 l/min, it is found to be advantageous if the inner diameter is approximately 18 mm, in order obtain a flow rate inside the cyclone separator that is nearly as great, due to the smaller flow cross-section. With the smallest quantity of crankcase gas typically occurring, 40 l/min, an inner diameter of approximately 24 mm should be suitable, again with a helix height (slope) of 13 mm and an outer diameter of 51 mm.

An oil separator for crankcase gases of the generic type is made known in DE 197 00 733 A1. This publication discloses and teaches that the components of the oil separator named initially are to be located in the cylinder-head hood of the internal combustion engine. The preliminary separator and the cyclone separator are located on the inside of the cylinder-head hood, i.e., on the side of the cylinder-head hood facing the crankcase and/or camshaft housing. The fine separator and the valve device are located between two housing cover halves of the cylinder-head hood and are located downstream from the cyclone separator in terms of flow. This means of attaining the object of the invention entails a great deal of integration expense in terms of structurally locating the oil separator components in the cylinder-head hood. It is also entails a very tall height.

In a further development of the invention, the oil separator is designed so that the preliminary separator, the cyclone separator, the fine separator and the valve device provided, if necessary, are located on the outside of the cylinder-head cover and are covered with a housing half-shell which, together with the outside of the cylinder-head hood, forms a housing for the oil separator and can be installed against the outside of the cylinder-head hood in sealing fashion.

The arrangement of the components of the oil separator outside the cylinder-head hood itself opens up the possibility of producing all components in one housing, i.e., a housing half-shell of the oil separator, as a subassembly that can be pre-assembled, and then adjoining this subassembly in entirety, in modular fashion, with or without an additional bottom part, to the outside of the cylinder-head hood. In particular, the cylinder-head hood—detached from components of the oil separator—can be installed on the cylinder head in order to seal off the top of the camshaft housing. The preassembled subassembly of the oil separator can then be installed at this time or a later time.

It is found to be particularly advantageous when the housing half-shell—which forms a housing for the oil separator—is a plastic part produced as a single component, in particular an injection-molded part.

With regard for the ability of the oil separator to be preassembled in specific subassemblies, it is found to be particularly advantageous when flow guide walls of the preliminary separator, a helical insert for the cyclone separator, a separator insert for the fine separator, and preferably the valve device as well, can be placed in the housing half-shell for preassembly. All components with regard for the housing half-shell can then be preassembled, stockpiled as ready-to-install subassemblies, and then delivered to the cylinder-head hood at the desired point in time for final assembly.

The housing half-shell should be advantageously designed rather flat and elongated in shape. To handle crankcase gases of up to 150 l/min, a diameter of only approximately 295×60×70 mm (length×width×height) has been found to be sufficient; with this, it was possible to separate oil quantities of 100 to 200 g/h. In order to obtain these quantities using non-generic, modular designs of externally adjoined cyclone separators, a much greater overall height of 175 mm and a length and width of 105×90 mm was required until now. The design according to the invention makes it possible to realize pancake-designed, elongated dimensions when configuring the oil separator in the range described hereinabove, which said dimensions are sufficient in terms of their efficacy, throughput rate, and separation capacity.

It is found to be advantageous when the housing half-shell comprises circumferential side walls extending in the direction toward the cylinder-head hood that transition into a full-perimeter, front edge facing the cylinder-head hood, with which the housing half-shell can be placed against the outside of the cylinder-head hood in sealing fashion.

This full-perimeter, front edge can advantageously define a seating plane, which then makes it necessary to design the outside of the cylinder-head hood correspondingly flat in the region where the oil separator is installed. A design of the housing half-shell of the oil separator having circumferential side walls extending in the direction toward the cylinder-head hood, i.e., having a substantially pot-shaped geometry, makes it possible in particularly advantageous fashion to preassemble all components in the protected and prefabricated housing, which then only need be joined with the outside of the cylinder-head hood via its full-perimeter edge. As an alternative or in addition, a bottom part could close the housing half-shell of the subassembly, in particular except for afflux and return openings.

BRIEF DESCRIPTION OF THE DRAWINGS

Further features, details, and advantages of the invention result from the attached claims, the drawings, and the subsequent description of a preferred exemplary embodiment of the oil separator according to the invention.

DETAILED DESCRIPTION OF THE PREFERRED EMBODIMENTS

Figure 1:
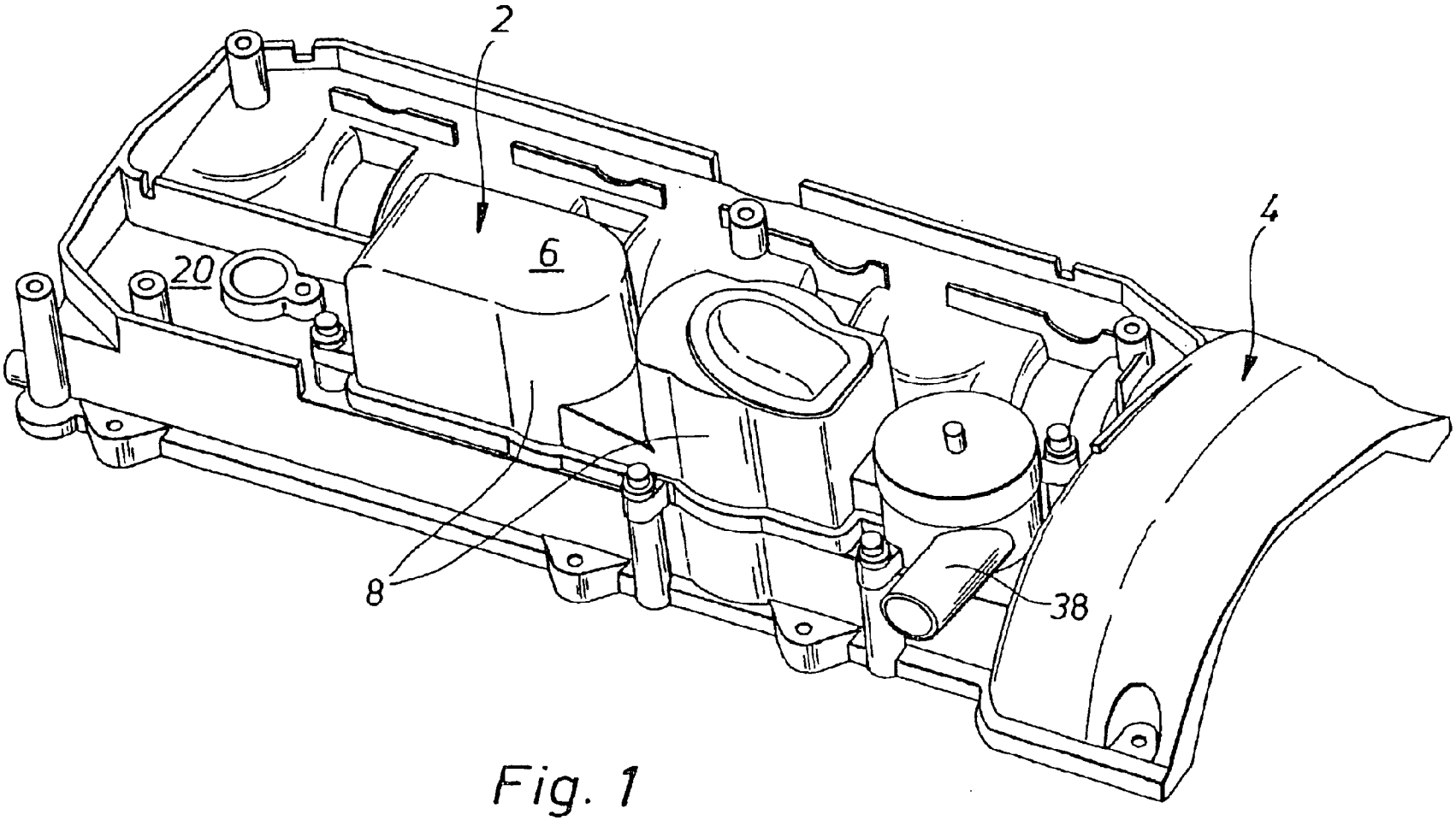
FIG. 1 is a perspective view of an oil separator according to the invention in the installed state on the outside of a cylinder-head hood.
Figure 2:
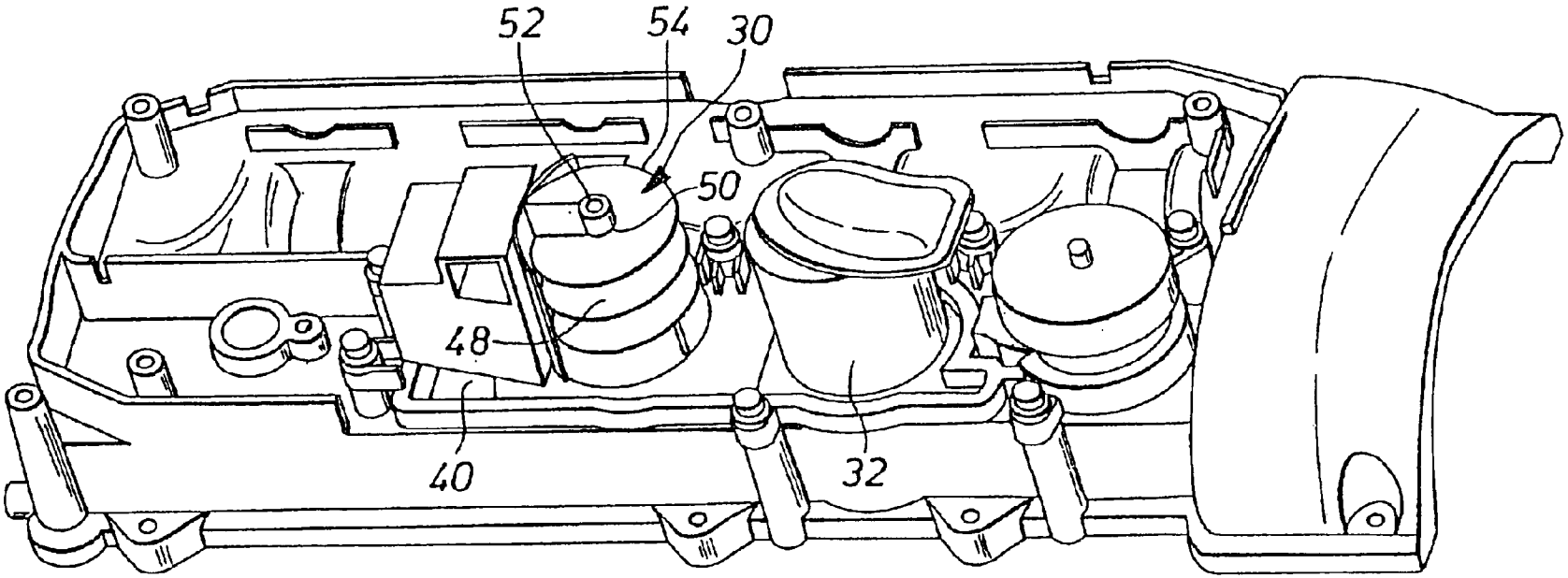
FIG. 2 is a perspective illustration according to FIG. 1 with partially cut-away walls of the oil separator.
Figure 3:
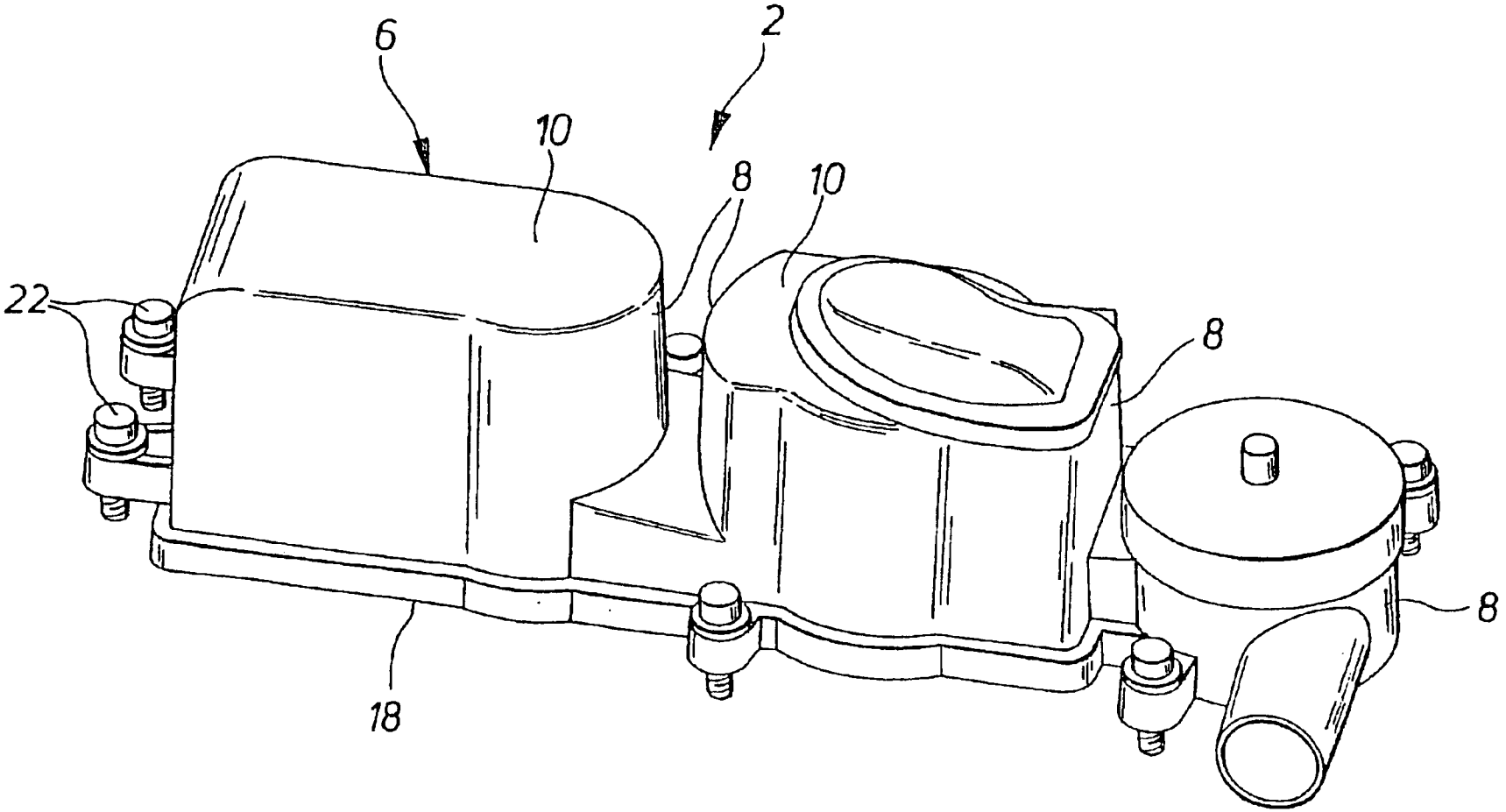
FIG. 3 is a perspective illustration of the oil separator according to FIG. 1.
Figure 4:
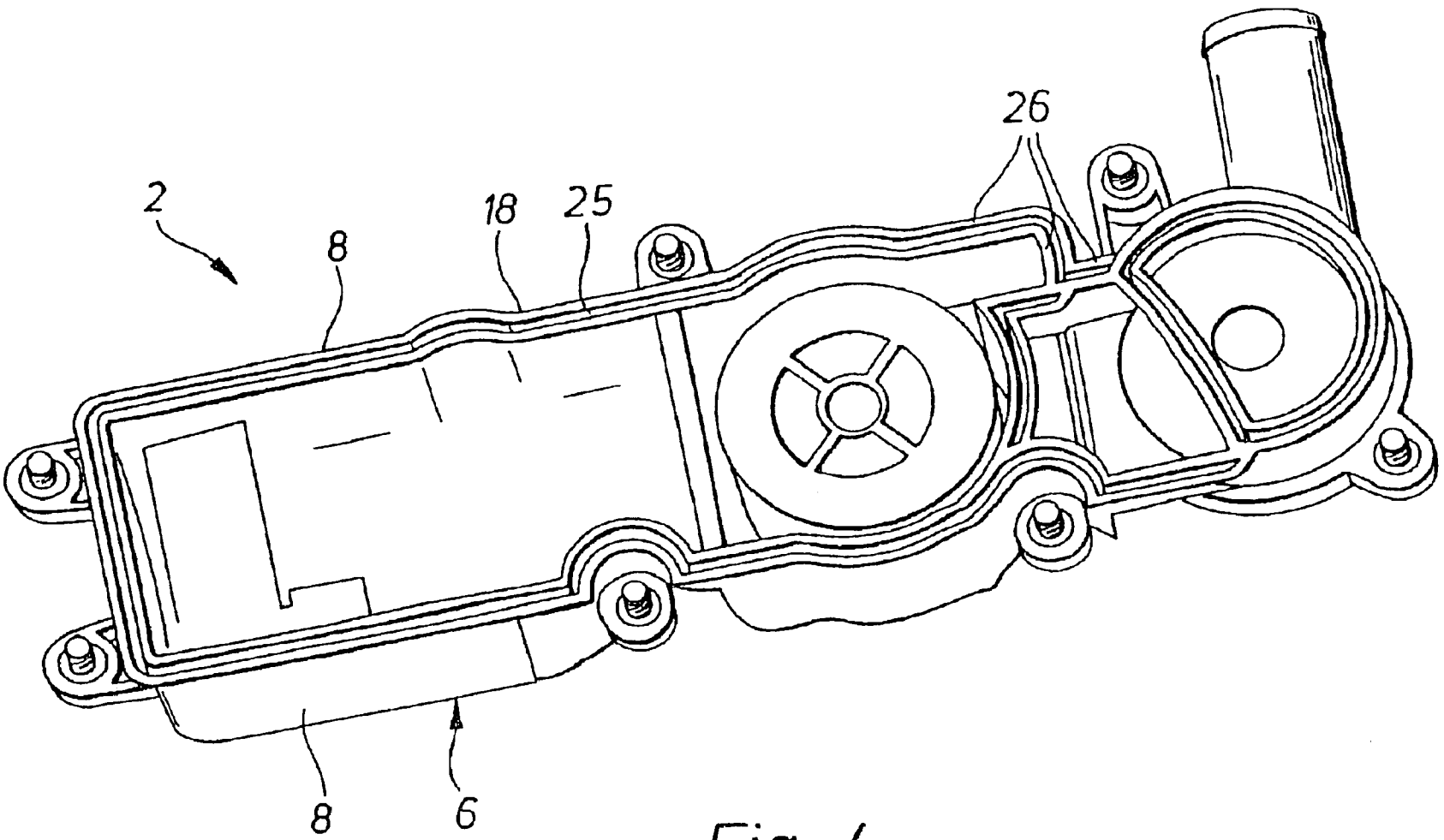
FIG. 4 is a perspective view of the oil separator according to FIG. 3 from below (the side to be mounted on the cylinder-head hood)
Figure 5:
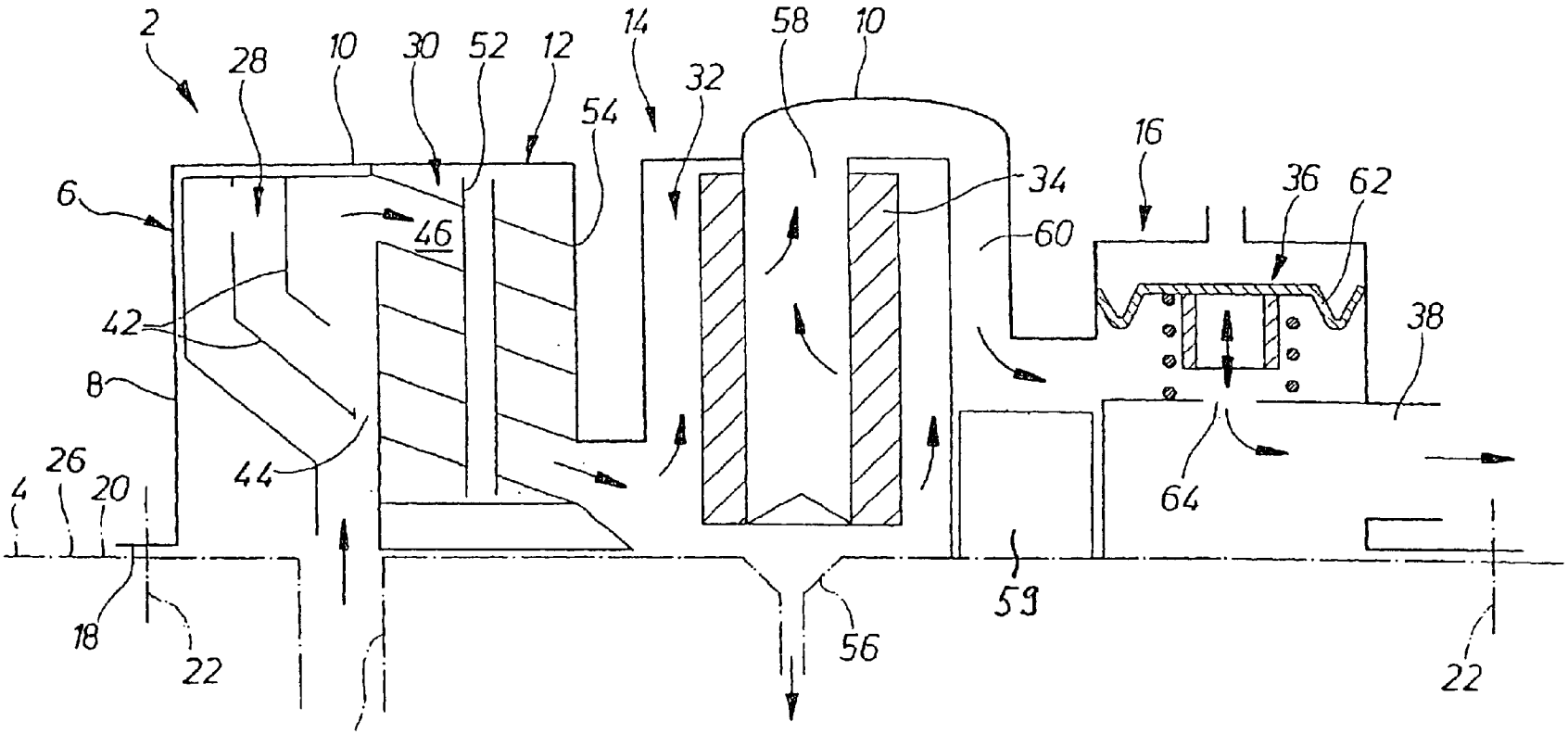
FIG. 5 is a schematic sectional view through an exemplary embodiment of the oil separator according to the invention with cylinder-head hood indicated only schematically.

FIG. 1 shows a perspective view of an oil separator 2—labelled in entirety with reference numeral 2 and to be described in detail hereinbelow—in the installed state on the outside of a cylinder-head hood—labelled in entirety with reference numeral 4—of an internal combustion engine. FIGS. 3 and 4 show a perspective view of the oil separator 2. Reference will also be made to FIG. 5 hereinbelow, which is a sectional view of the oil separator 2 shown partially schematically.

The oil separator 2 comprises a housing half-shell 6 that houses all components of the oil separator 2. The housing half-shell 6 is a plastic injection-molded part produced as a single component that comprises circumferential side walls 8 extending in the direction toward the cylinder-head hood 4. The circumferential side walls 8 start from a top cover wall 10, and a plurality of pot-shaped housing regions 12, 14, 16 are formed. The respective circumferential side walls 8 transition into a full-perimeter edge 18 on the front side, with which the housing half-shell 6 can be placed against the outside 20 of the cylinder-head hood 4 in sealing fashion. The housing half-shell 6 can then be screwed together with the outside 20 of the cylinder-head hood 4 via screws 22 indicated in FIG. 5 and illustrated in FIGS. 1 through 4. One can see lugs 23 of the housing half-shell 6 projecting laterally away from the circumferential side walls 8, through which the screws 22 are guided. The screws 22 are screwed into dome-shaped raised areas 24 that project out of the outside 20 of the cylinder-head hood 4. In order to seal off the interior of the housing half-shell 6, a substantially full-perimeter groove 25 for a cord seal that is not shown but that can be inserted there is formed in the edge 18 extending around the perimeter on the front.

The full-perimeter, front edge 18 forms or defines a seating plane 26. In order to place the oil separator against the outside 20 of the cylinder-head hood 4 in sealing fashion via its housing half-shell 6 and install it there, the only requirement is to design a region on the outside 20 of the cylinder-head hood 4 extending in the region of the front edge 18 correspondingly flat. No complicated adjustment procedures to cylinder-head hoods having various designs are therefore necessary. Instead, the pertinent cylinder-head hoods having various designs for various internal combustion engines need only comprise an outside designed in accordance with the housing half-shell or in accordance with its front edge 18 and, in the simplest case, one flat section (but only along the extent of the edge 18).

The housing region 12 forms a substantially pot-shaped chamber in which a preliminary oil separator 28 and a cyclone separator 30 are provided. Contained in the pot-shaped housing region 14 adjacent to this is a fine separator 32 having a fine separator insert 34 designed as a thread spool, for example. Housing region 16—which is not as tall as housing regions 12, 14—contains a valve device 36 that opens or closes an outlet 38 of the oil separator 2 to the intake side of the not-shown internal combustion engine and therefore limits the upper pressure of the crankcase gases.

The separation stages arranged in a cascade are designed as follows:

The preliminary separator 28 is located above an afflux opening 40 for crankcase gases in the cylinder-head hood 4 and comprises—as shown in FIG. 5—flow guide walls 42 that cause the crankcase gases flowing into the oil separator 2 to be redirected, preferably multiple times. Provided at the lowest point after the first redirection inside the preliminary separator 28 is a return opening 44 for fluid separated in this stage. From the return opening 44 on the bottom end of a flow guide wall 42, the separated fluid then drips downward against the flow of the crankcase case and thereby directly re-enters the engine compartment below the cylinder-head hood 4. At the top, i.e., in the region of the inside of the cover wall 10, the flowing crankcase gas enters the cyclone separator 30 located downstream in the manner of a cascade. Said cyclone separator comprises a helical flow path 46. The helical flow path 46 is formed by a helix 48 having a central opening 50 through which a tubular or cylindrical internal part 52 is inserted and is interconnected with the helix 48 substantially tightly. The circumferential edges 54 of the helix 48 bear against the inside of the circumferential side walls 8 of the housing half-shell 8 in substantially sealing fashion. In this fashion, the helical passages of the helix 48 are formed and limited by the internal part 52, and the helical flow paths 46 are formed and limited by the housing half-shell 6. Due to forces of inertia, the fluid components in the helically-flowing crankcase gas are separated radially outwardly, and they flow down the helical path because of their weight.

The radial depth of the helical flow path 46 can be varied in particularly advantageous fashion. This can take place, in particular, by inserting various helixes 48 having various radial depths, which is preferably achieved using variously-sized internal parts 52 of the helix 48 while the outer diameter of the helix 48 remains the same. In this manner, a different flow cross-section can be obtained by selecting and inserting different helixes, in order to adjust for various engines and applications while the structural design and dimensions of the oil separator 2 otherwise remain the same.

The fine separator 32, which is located in the housing region 14 downstream in terms of flow, comprises a cylindrical thread spool as the fine separator insert 34 that is closed on its side closest to the cylinder head. The flowing crankcase gases pass through the cylindrical wall of the thread spool, whereby the remaining ultra-fine fluid droplets are separated out and, because of their weight, move downward inside the thread spool in the direction toward the cylinder-head hood. An oil drain opening 56—indicated only schematically in FIG. 5—is provided there in the cylinder-head hood. The thread spool comprises an outlet opening 58 on its top end. The cover wall 10 is arched somewhat upwardly in this region. The crankcase gases flowing through the outlet opening 58 are then redirected by 90° directly in the region of the dome, but then they are redirected once more downwardly by 90° in the direction toward the cylinder-head hood 4. By designing the domed part 10 as a separate component, production of the housing half-shell 6 is greatly simplified with regard for forming expense. Due to the very steep design of the transfer passage 60, the space required in the longitudinal direction is kept to a minimum. An opposed shape 59 projects into a recess between the housing regions 14 and 16—that is formed on the cylinder-head hood—so that no dead volume forms in which fluid could collect. Exiting the transfer passage 60, the flowing crankcase gas enters the housing region 16, where the valve device 36 is provided. The valve device 36 comprises a diaphragm 62—indicated schematically in FIG. 5—which is open to the atmosphere on one side and is acted upon by crankcase gas on the other. When the internal combustion engine undergoes maximum induction, i.e., when a maximum vacuum exists in the outlet 38 of the oil separator, the valve device 36 closes an opening 64 and, in fact, under the pressure from the atmosphere. If the pressure underneath the membrane 62 increases due to the crankcase gas, the opening 64 is opened, and crankcase gases are directed to (renewed) combustion.

Figure 6:
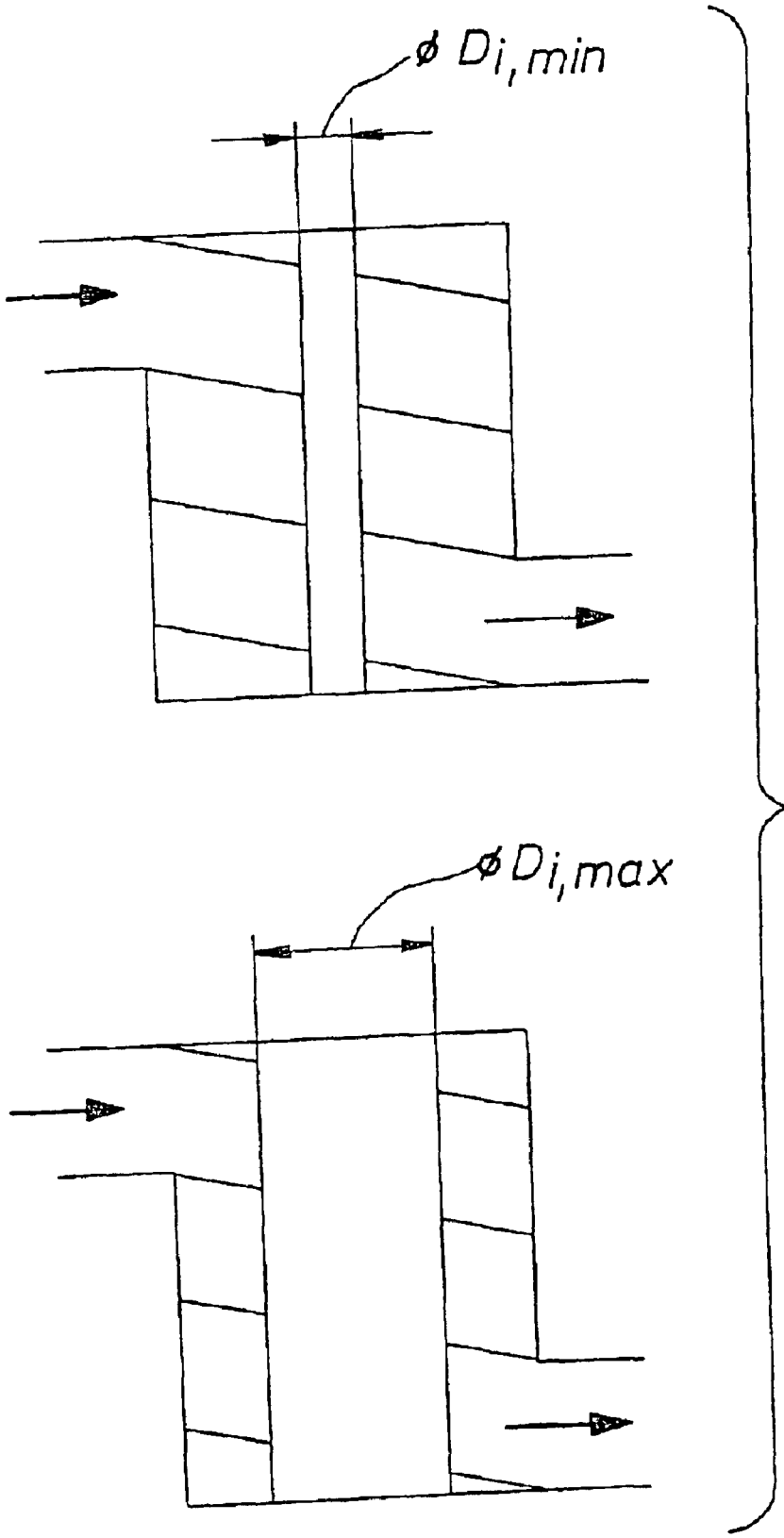
FIG. 6 shows two schematic illustrations of different helical inserts for the oil separator according to FIG. 4.

FIG. 6 shows a schematic illustration of two different embodiments of helixes 48 having different radial depths of the flow path that are obtained by means of cylindrical internal parts 52 having different diameters, while the outer diameter of the helix 48 remains the same.

What is claimed is:

1. An oil separator (2) for crankcase gases of an internal combustion engine, comprising a preliminary separator (28), a cyclone separator (30) having a helical flow path, a fine separator (32) and, if necessary, a valve device (36) that are provided in a cascade arrangement on a cylinder-head cover (4) of the internal combustion engine, wherein a different helix (48) having predetermined radial depth of the flow path is inserted in a housing section for the cyclone separator (30).

2. The oil separator of claim 1, wherein the helixes (48) having different radial depths of the flow path have the same outer dimensions.

3. The oil separator according to claim 1, wherein a helix comprises a cylindrical internal part (52), whereby the cylindrical internal part (52) defines an inner diameter $D_i$ of the helical flow path (46).

4. The oil separator according to claim 1, wherein, in the case of a cyclone separator (30) having a helical path height of 11–15 mm and an outer diameter $D_a$ of 48–54 mm, the maximum inner diameter $D_{i,max}$ is approximately 8 mm (±10%).

5. The oil separator according to claim 1, wherein, in the case of a cyclone separator (30) having a helical path height of 11–15 mm and an outer diameter $D_a$ of 48–54 mm the maximum inner diameter $D_{i,max}$ is approximately 18 mm (±10%).

6. The oil separator according to claim 1, wherein, in the case of a cyclone separator (30) having a helical path height of 11–15 mm and an outer diameter $D_a$ of 48–54 mm, the maximum inner diameter $D_{i,max}$ is approximately 24 mm (±10%).

7. The oil separator according to claim 1, wherein the preliminary separator (28), the cyclone separator (30), the fine separator (32) and the valve device (36) provided, if necessary, are located on the outside (20) of the cylinder-head hood (4) and are covered by a housing half-shell (6), which, together with the outside (20) of the cylinder-head hood (4), forms a housing for the separator (2).

8. The oil separator according to claim 7, wherein the housing half-shell (6) is a plastic part produced as a signal component, in particular an injection-molded part.

9. The oil separator according to claim 7, wherein the flow guide walls (42) and/or a helix (48) for the cyclone separator (30) and/or a separator insert (34) for the fine separator (32) and/or the valve device (36) are capable of being inserted in the housing half-shell (6) as preassembled units.

* * * * *